US005859614A

United States Patent [19]

Paolella et al.

[11] Patent Number: 5,859,614

[45] Date of Patent: Jan. 12, 1999

[54] LOW-LOSS APERTURE-COUPLED PLANAR ANTENNA FOR MICROWAVE APPLICATIONS

[75] Inventors: Arthur C. Paolella, Howell; Dana J. Sturzebecher, Tinton Falls; Felix Schwering, Eatontown, all of N.J.

[73] Assignee: The United States of America as represented by the Secretary of the Army, Washington, D.C.

[21] Appl. No.: 648,265

[22] Filed: May 15, 1996

[51] Int. Cl.[6] ..... H01Q 1/38

[52] U.S. Cl. ..... 343/700 MS; 343/873

[58] Field of Search ..... 343/700 MS, 873; 333/26; H01Q 1/38

[56] References Cited

U.S. PATENT DOCUMENTS

| | | | |
|---|---|---|---|
| 4,445,121 | 4/1984 | Hancock et al. | 343/700 MS |
| 4,816,836 | 3/1989 | Lalezari | 343/873 |
| 4,937,585 | 6/1990 | Shoemaker | 343/700 MS |
| 5,155,493 | 10/1992 | Thursby et al. | 343/873 |
| 5,181,025 | 1/1993 | Ferguson et al. | 373/700 MS |
| 5,210,542 | 5/1993 | Pett et al. | 343/700 MS |
| 5,355,143 | 10/1994 | Zurcher et al. | 343/700 MS |
| 5,455,594 | 10/1995 | Blasing et al. | 343/700 MS |

OTHER PUBLICATIONS

Robertson, S.V. et al., "W–Band Microshield Low–Pass Filters", 1994 IEEE MTT–S Digest, pp. 625–628.

*Primary Examiner*—Michael C. Wimer
*Attorney, Agent, or Firm*—Michael Zelenka; John M. O'Meara

[57] ABSTRACT

A planar antenna for microwave applications includes a supporting structure that is made using standard LTCC (low temperature co-fired ceramics) multi-layer techniques and a polyimide tape containing an adhesive at one side which is adheringly attached to the supporting structure. The body of the supporting structure defines a transmission line substrate and several of the intermediate layers define a path for microwave energy to be coupled from the transmission line substrate to the antenna. The method includes adhering the tape to the supporting structure, cutting the tape to size, and baking the tape and supporting structure in an oven at about 180° C. for about 4 hours to rigidify the tape. The obtained antenna is thus protected against substrate effects such as TM mode zero cut-off frequencies.

9 Claims, 3 Drawing Sheets

LOW-LOSS APERTURE-COUPLED PLANAR ANTENNA FOR MICROWAVE APPLICATIONS

GOVERNMENT INTEREST

The invention described herein may be manufactured, used, imported and licensed by or for the Government of the United States of America without the payment to us of any royalties thereon.

FIELD OF THE INVENTION

This invention relates to a microwave element and is more specifically directed to an antenna and to a method of making a low-loss aperture-coupled planar antenna for microwave applications.

BACKGROUND OF THE INVENTION

Typical planar antennas are printed on high dielectric constant materials. For the case of a low temperature co-fired ceramic (LTCC), the value of the dielectric constant is fixed at 5.9, which can result in performance degradations due to substrate effects. Principally, the surface wave modes propagating in the substrate are always present, since the TM mode has a zero cut-off frequency despite the value of the substrate height, h, or its dielectric constant, $\epsilon_r$. Higher order modes can be reduced or prevented from propagating by selecting a low value of h or $\epsilon_r$. Recent research has developed a low loss membrane technique in semiconductor materials for use with millimeter applications. However, this is not a practical approach at microwave frequencies in the LTCC process.

The aforementioned research, reported in a 1994 article entitled *W-BAND MICROSHIELD LOW-PASS FILTERS,* by Stephen V. Robertson, Linda P. B. Katehi and Gabriel M. Rebeiz, 1994 IEEE MTT-S Digest, pages 625–628, describes experimental and theoretical results obtained from fabricating a planar W-band low-pass filter. The described filter is fabricated in microshield line technology, and includes a new type of planar transmission line, based on a coplanar waveguide supported by a thin dielectric membrane. The article specifically reports on the results of a planar 90 GHz low-pass filter which has been fabricated in microshield line using the aforementioned membrane technology. The device is purported to display excellent performance, including low-pass band insertion loss and low total loss. In any event, it demonstrates the efficacy of using membrane technology.

SUMMARY OF THE INVENTION

Accordingly, it is an object of the present invention to provide a low-loss aperture-coupled planar antenna which is substantially immune to substrate effects.

It is a further object of the present invention to provide a method for making such a low-loss aperture-coupled planar antenna.

Yet another object of the invention is to provide a method of making a low-loss aperture-coupled planar antenna using a thin dielectric film, to improve the performance by eliminating high order modes, substrate losses and dispersion effects.

A still further object of the invention is to provide a fabrication method for making a low-loss aperture-coupled planar antenna that is low in cost, provides high yield and uses only commercially available films and ceramics.

The foregoing and other objects of the present invention are accordingly realized in a form of an aperture-coupled device for microwave applications, which includes a radiating element, a transmission line substrate for carrying microwave energy and several intermediate layers disposed between the transmission line substrate and the radiating element. The radiating element is located on a thin film membrane which is disposed over the intermediate layers and an energy path, in the form of apertures and windows in the intermediate layers, serves to provide a microwave energy path from the transmission line substrate to the radiating element. In this manner, energy is coupled from the transmission line substrate to the radiating element immunized from substrate effects.

In accordance with preferred embodiments of the invention, the intermediate layers includes a metal ground layer with an aperture over the microstrip transmission line and a low temperature co-fired ceramic substrate with a window overlapping the aperture. The thin film membrane is preferably an about 0.001 inch thin film made of 3M KAPTON® polyimide tape. A metal line is connected to the underside of the microstrip transmission line to launch microwave energy into the structure.

The method of making the device of the present invention includes providing a supporting structure comprising the aforementioned transmission line and intermediate layers, by using standard LTCC (low temperature co-fired ceramic) multi-layer fabrication techniques. The polyimide tape has an adhesive on its underside, by which it is adhered to the supporting structure. The radiating element is made by depositing metal on the tape and etching the metal to obtain a desired antenna pattern.

Other features and advantages of the present invention will become apparent from the following description of the invention which refers to the accompanying drawings.

DETAILED DESCRIPTION OF THE DRAWINGS

Figure 1:
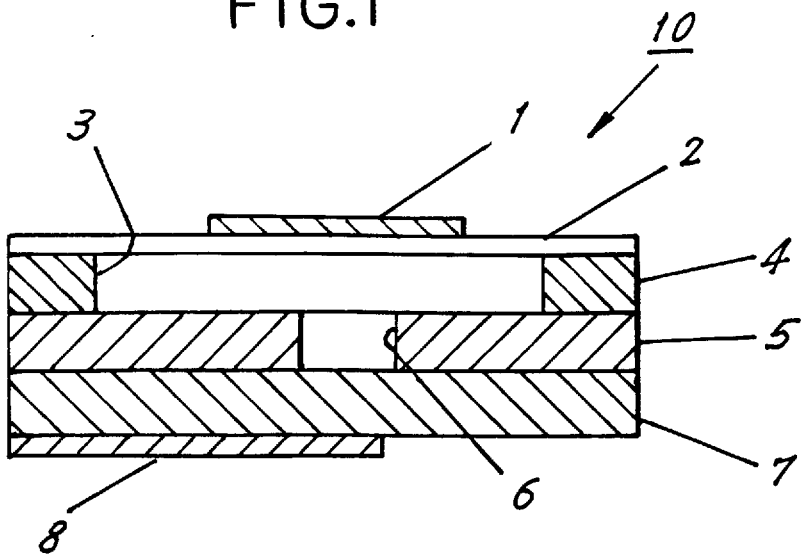
FIG. 1 is a cross section through the low-loss aperture-coupled planar antenna of the present invention.
Figure 2:
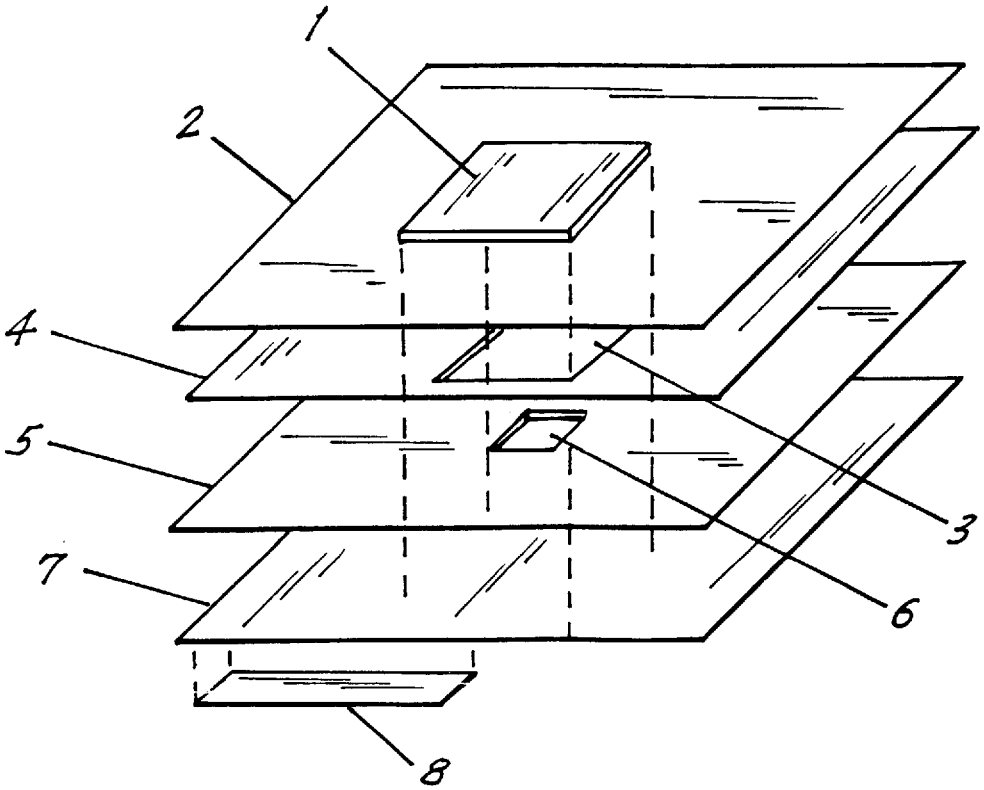
FIG. 2 is an exploded perspective of the low-loss aperture-coupled planar antenna of the present invention.

The planar antenna depicted in cross section in FIG. 1 and perspectively (in an exploded view) in FIG. 2, employs an aperture-coupled design as described below. The device 10 includes a radiating element 1 which is disposed on a thin film made of 3M KAPTON® polyimide tape 2 having a thickness of about 0.001 inches. The tape 2 is bonded to a low-temperature co-fired ceramic substrate 4 in which a window 3 has been cut so as to eliminate substrate effects. The LTCC substrate 4 is in turn bonded to a metal ground plane 5 in which an aperture 6 has been formed, at a position below the window 3 of the LTCC substrate 4.

The radiating element 1 is excited by microwave energy which is launched into a microstrip transmission line which comprises a the metal ground plane 5 and second LTCC substrate that is in turn connected, on the underside thereof, with a metal line 8. Thereby, microwave energy, launched into the substrate 7 from the metal line 8, is able to propagate through the aperture 6 and window 3 to the radiating element 1.

The method of making the planar antenna 10 includes, as illustrated in FIGS. 3A–3J, providing a supporting structure 12 (FIG. 3A) which contains the elements 3–8 described above, using standard LTCC multi-layer techniques which are in and of themselves known in the art.

Figure 3A:
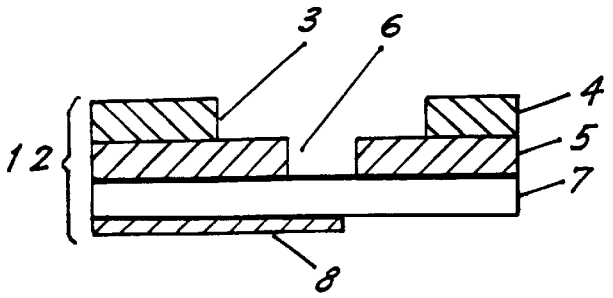
FIGS. 3A, 3B, 3C, 3D, 3E, 3F, 3G, 3H, 3I, and 3J show successive stages in the fabrication process of the device of the present invention.
Figure 3B:
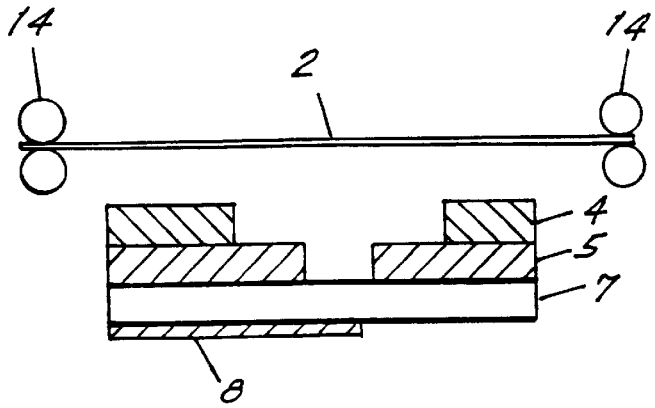
Figure 3C:
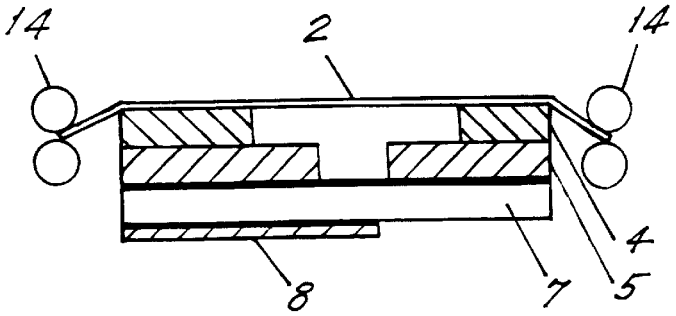

The method includes obtaining a length of the polyimide tape 2 and fixing two ends thereof in a support holder 14 and thereafter stretching the tape laterally to reduce sagging. The process further includes pressing the support structure 12 against the underside of the tape 2 to cause the substrate 4 to contact the tape with sufficient force so as to create an adhesive bond therebetween (FIG. 3C).

Figure 3D:
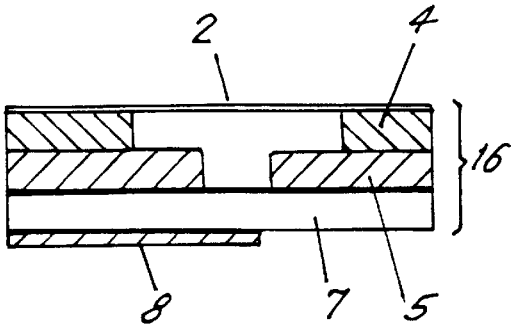
Figure 3E:
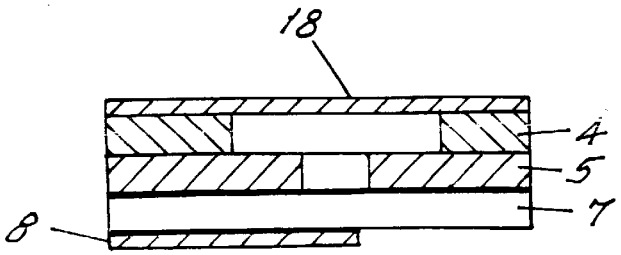
Figure 3F:
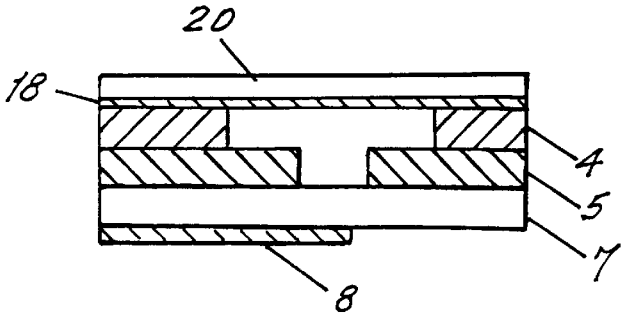
Figure 3G:
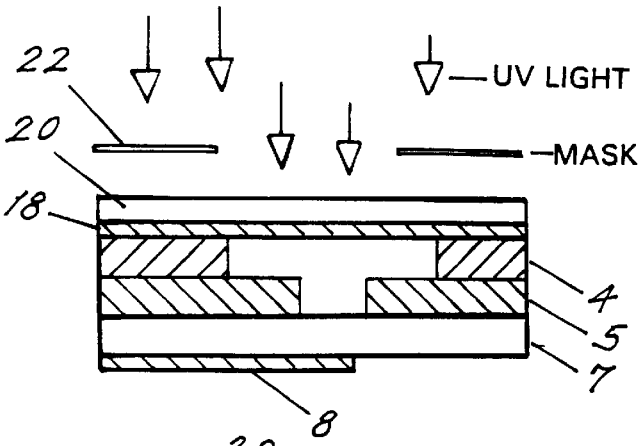
Figure 3H:
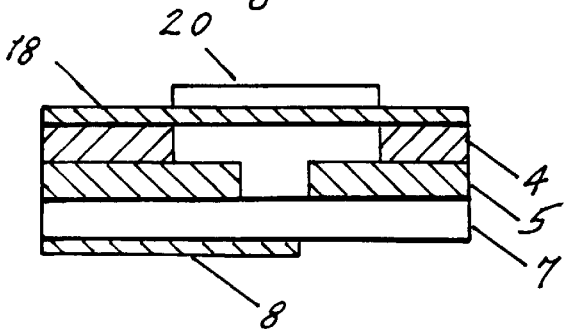
Figure 3I:
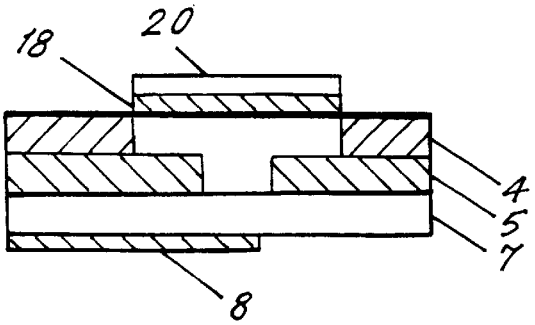
Figure 3J:
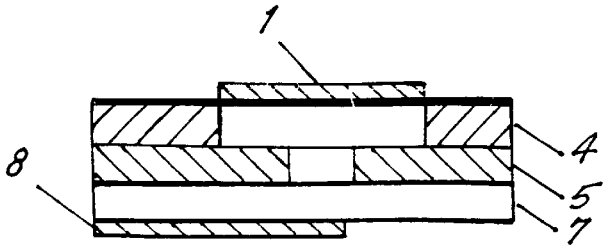

As seen in FIG. 3D, the excess tape is then cut to proper size and the entire unit 16 including the tape 2 and the support structure 12 is baked in an oven at about 180° C. for approximately four hours. This causes the tape to become rigid. FIG. 3E shows the step of depositing a metal layer 18 on top of the tape 2, by sputtering or other suitable technique, and following up that step with the application of the UV sensitive photoresist 20 as indicated in FIG. 3F. The process continues by providing a mask 22, containing a desired antenna pattern (not shown), above the photoresist 20 and thereafter using an ultraviolet light source to expose the underlying photoresist 20 to develop a pattern (FIG. 3G). FIG. 3H illustrates the shape of the metal layer after the photoresist has been washed away in a first rinse. The exposed metal is then etched to form the antenna as illustrated in FIG. 3I, the process concluding with the washing away of any remaining photoresist using a second rinse to obtain the radiating element 1 shown in FIGS. 1 and 3J.

Although the present invention has been described above in relation to the fabrication of a low-loss aperture-coupled planar antenna, the process of the present invention can be used to fabricate other microwave structures, such as transmission lines with low dispersion and coupling lines for filters. The process may also include the step of filling the empty space comprising the window and aperture in FIG. 1 with a low dielectric constant liquid polymer to increase mechanical stability while maintaining all of the features sought by the present invention. The polymer material when exposed to ultraviolet becomes solid. The overall structure of the invention is believed by the inventors thereof to provide improved performance over conventional planar antennas.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An aperture-coupled device for microwave operation, the device comprising:

a radiating element;

a transmission line substrate for carrying microwave energy;

a plurality of intermediate layers disposed over the transmission line substrate;

a thin film membrane disposed over the intermediate layers at a spacing from the transmission line substrate so as to substantially eliminate substrate effects, and having the radiating element located thereon;

a microwave energy path defined in the intermediate layers and passing from the transmission line substrate to the radiating element; and the intermediate layers include a first layer disposed over the transmission line substrate and having an aperture there-through that defines a portion of the energy path, along with a low temperature co-fired ceramic substrate disposed over the first layer and having a window therethrough that overlaps the aperture to couple microwave energy with the radiating element.

2. The device of claim 1, in which the membrane is a polyimide tape.

3. The device of claim 2, in which the polyimide tape is bonded to the low temperature co-fired ceramic substrate.

4. The device of claim 2, further including a metal line coupled to the transmission line substrate to launch microwave energy into the transmission line substrate.

5. The device of claim 2, in which the first layer comprises a metal ground plane.

6. The device of claim 2, in which the transmission line substrate is a microstrip transmission line.

7. The device of claim 6, in which the microstrip transmission line comprises a low temperature co-fired ceramic layer.

8. The device of claim 1, in which the radiating element is a metal layer defining an antenna pattern.

9. The device of claim 2, further including a liquid polymer disposed in the window.

* * * * *